United States Patent [19]

Vescia et al.

[11] 3,989,456

[45] Nov. 2, 1976

[54] DYEING OF POLYESTER FIBERS

[75] Inventors: Michele Vescia, Limburgerhof; Manfred Daeuble, Frankenthal; Rudi Widder, Leimen, all of Germany

[73] Assignee: BASF Aktiengesellschaft, Ludwigshafen (Rhine), Germany

[22] Filed: Mar. 6, 1975

[21] Appl. No.: 556,019

[30] Foreign Application Priority Data

Mar. 22, 1974 Germany ..... 2413866

[52] U.S. Cl. ..... 8/169; 8/94 A

[51] Int. Cl.[2] ..... D06P 5/04

[58] Field of Search ..... 8/169, 94 A

[56] References Cited

UNITED STATES PATENTS

| | | | |
|---|---|---|---|
| 2,323,871 | 7/1943 | Kienle et al. | 8/62 |
| 3,083,074 | 3/1963 | Murphy et al. | 8/159 |
| 3,112,983 | 12/1963 | Collins | 8/54 |

OTHER PUBLICATIONS

Clark, Reports on the Progress of Applied Chemistry, 1975, 58, pp. 124–133.

Peters and Stevens, J. Soc. Dyers Colorists, 1958, (Mar.), p. 183.

Karrholm and Lindberg, Textile Res. J., 1956, (July), pp. 528–530.

*Primary Examiner*—Joseph L. Schofer
*Assistant Examiner*—A. L. Clingman
*Attorney, Agent, or Firm*—Johnston, Keil, Thompson & Shurtleff

[57] ABSTRACT

Polyester fibers are dyed level shades at above 100° C with disperse dyes from an aqueous liquor containing emulsions of aliphatic alcohols of 8 to 12 carbon atoms.

9 Claims, No Drawings

DYEING OF POLYESTER FIBERS

The invention relates to a process for dyeing polyester fibers at above 100° C with disperse dyes from an aqueous liquor containing emulsions of aliphatic alcohols of 8 to 12 carbon atoms as leveling agents.

It is known that oxyethylation products of organic compounds of various types, such as fatty alcohols, alkylphenols and fatty acids, and also polypropylene glycols, act as leveling agents for dyeing polyester fibers. This effect is described eg., in German Printed applications Nos. 1,184,730, 1,280,805 and 1,286,499. However, these products greatly retard the dyes used, so that the same amount of dye gives substantially paler dyeings than in the absence of the auxiliary.

Carriers of a variety of types may also be used as leveling agents. However, they detract from the lightfastness of the dyeings unless they are completely removed from the polyester fibers after dyeing. If they are used in excessive amounts, they lower the tenacity of the fibers and produce paler dyeings.

German Published application No. 1,619,489 proposes the use of a mixture of oxyethylation products, salts of alkylbenzenesulfonic acids and alcohols of 3 to 6 carbon atoms as an emulsifier for various carriers such as benzoic acid esters or p-chlorophenyl glycol esters. It has been found that these alcohols are ineffective as leveling agents; in the said German Published Application, they are used solely as means of stabilizing the emulsions of typical aromatic carriers.

It is an object of the present invention to provide an economical process for the level dyeing of polyester fibers, avoiding all the above disadvantages of conventional leveling agents.

We have found that this object is achieved by a process for dyeing polyester fibers at above 100° C with disperse dyes from an aquous liquor, wherein emulsions of aliphatic alcohols of 8 to 12 carbon atoms are present.

We have also found that the said fatty alcohols are more effective if the carbon chain is straight or only slightly branched than if it is more heavily branched. Examples of suitable alcohols are octanol, nonanol, decanol, their methyl or ethyl derivatives, undecanol and dodecanol. They are employed in amounts of from 0.05 to 0.5, preferably from 0.1 to 0.3, percent by weight, based on the dye liquor, and of from 0.5 to 10, preferably from 1 to 8, percent by weight, based on the goods to be dyed.

Mixtures of anionic and non-ionic surfactants have proved the most suitable emulsifiers. Particularly effective anionic components are the alkali metal salts, above all the sodium and potassium salts, and the ammonium salts, of sulfuric acid half-esters of fatty alcohols, of 9 to 18 carbon atoms, which are oxyethylated 2-fold to 4-fold, or of similarly oxyethylated alkylphenols, or corresponding salts of alkylbenzenesulfonic acids, wherein alkyl is of 6 to 12 carbon atoms in each case. These anionic surfactants are employed in amounts of from 2.5 to 30, preferably from 5 to 20, percent by weight, based on the above aliphatic alcohols.

Particularly suitable non-ionic surfactants are fatty acids oxyethylated with from 5 to 15 moles of ethylene oxide or castor oil oxyethylated with from 30 to 50 moles of ethylene oxide. These are employed in amounts of from 5 to 40, preferably from 10 to 30, percent by weight, based on the above aliphatic alcohols.

The leveling action of a leveling agent may be tested by treating previously dyed polyester material together with undyed material at a specified temperature and for a specified period in a liquor containing the products to be tested. Depending on the effectiveness of the leveling agents, the dyes migrate to a greater or lesser degree from the dyed to the undyed material. This test shows the effectiveness of a leveling agent in leveling out an uneven dyeing or in preventing unevenness.

The emulsions of the fatty alcohols of 8 to 12 carbon atoms are more effective leveling agents than lower or higher alcohols or most conventional leveling agents. In addition, they have none of the disadvantages mentioned earlier in connection with conventional leveling agents, ie. they have hardly any retarding effect and in no instance detract from the lightfastness of the dyeings and the tenacity of the fibers. We have also found that the temperature range within which dyes of different molecular sizes are taken up by fibers is reduced as a result of the addition of emulsions of the said alcohols so that improved levelness is obtained. This is very important in producing level dyeings; in addition, the subsequent boiling treatment can be shortened if level take-up of the dyes has been achieved a priori.

Polyesters in the present context are high molecular weight polymeric esters of aliphatic or, preferably, aromatic dicarboxylic acids, eg. terephthalic acid, and aliphatic diols, eg. ethylene glycol.

The phrase "*n*-fold oxyethylation" as employed herein denotes the formation of an addition product of n moles of ethylene oxide with one mole of the substance in question.

Ammonium salts in the present context are salts of ammonia or primary, secondary or tertiary amines wherein all the ligands of any one nitrogen atom together contain at most 18, and preferably at most 9, carbon atoms.

The dyeing temperatures used are as a rule from 120 to 135° C; naturally, this implies dyeing under superatmospheric pressure, for which the conventional high temperature dyeing apparatuses are used.

The examples which follow demonstrate the leveling action of the emulsified aliphatic alcohols by means of the leveling experiments described above. A sample of dyed and undyed knitted goods made of texturized polyester fibers is treated for 1 hour at 125° C in a blank liquor containing the emulsified alcohol or the leveling agent to be compared. The effect of the product tested can best be compared to that of conventional products by comparing the depth of shade of the originally undyed material in the experiment according to the invention and in the comparative experiment.

Comparative Experiment according to German Printed Application 1,184,730

10 parts by weight of knitted goods made from texturized polyester fibers, dyed with 0.1 part by weight of monobrominated 1,5-dihydroxy-4,8-diaminoanthraquinone, and 10 parts by weight of undyed knitted goods made from the same material are jointly treated for 1 hour at 125° C in 400 parts by volume of an aquous liquor containing 0.2 part by weight of 60 percent strength acetic acid and 1.2 parts by weight of the stearic acid ester of 1,4-butanediol-pentaglycol ether.

The initially dyed material is lightened whilst the undyed material is only slightly stained.

Comparative Experiment according to German Printed Application 1,280,805:

10 parts by weight of knitted goods made from texturized polyester fibers and dyed with 0.2 part by weight of disperse 1-amino-2-(4'-chlorophenoxy)-4-hydroxy-anthraquinone, and 10 parts by weight of undyed knitted goods made from the same material are jointly treated for 1 hour at 125° C in 500 parts by volume of an aquous liquor which contains 0.2 part by weight of an addition product of 2 moles of ethylene oxide with 1 mole of coconut fatty acid, 0.1 part by weight of polypropylene oxide of molecular weight 600, 0.1 part by weight of an addition product of 10 moles of ethylene oxide with 1 mole of nonylphenol and 0.1 part by weight of an addition product of 30 moles of ethylene oxide with 1 mole of nonylphenol.

The initially dyed material is lightened slightly whilst the initially undyed material is only slightly stained.

Comparative Experiment according to Example 2 of German Printed Application 1,296,499:

10 parts by weight of knitted goods made from texturized polyester fibers and dyed with 0.3 part by weight of 4-(p-toluidino)-1-hydroxy-anthraquinone and 10 parts by weight of undyed knitted goods made from the same material, are treated for 1 hour at 125° C in 500 parts by volume of a liquor which contains 0.16 part by weight of an addition product of 10 moles of ethylene oxide with 1 mole of nonylphenol and 0.09 part by weight of oleic acid hexaglycol ester.

The initially dyed material is lightened slightly whilst the initially undyed material is only slightly stained.

Comparative Experiment according to German Published Application 1,619,489:

10 parts by weight of knitted goods made from texturized polyester fibers and dyed with 0.2 part by weight of the dye of the formula

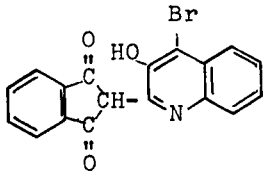

and 10 parts by weight of undyed knitted goods made from the same material are together treated for 1 hour at 125° C in 500 parts by volume of an aqueous liquor which contains 0.7 part of n-hexanol, 0.15 part of an addition product of 6 moles of ethylene oxide with 1 mole of oleic acid and 0.15 part of the diethanolamine salt of the sulfuric acid half-ester of an addition product of 3 moles of ethylene oxide with 1 mole of n-dodecyl alcohol.

The initially dyed material is lightened only slightly whilst the initially undyed material shows a relatively pale color.

If instead of n-hexanol, n-pentanol, iso-amyl alcohol, n-butanol or isobutanol is used, progressively weaker effects are found as the number of carbon atoms decreases.

The Examples which now follow illustrate the process according to the invention.

EXAMPLE 1

10 parts by weight of knitted goods made from texturized polyester fibers and dyed with 0.1 part by weight of mono- brominated 1,5-dihydroxy-4,8-diamino-anthraquinone and 10 parts by weight of undyed knitted goods made from the same material are together treated for 1 hour at 125° C in 500 parts by volume of an aqueous liquor which contains 0.8 part by weight of 2-ethylhexanol, 0.1 part by weight of an addition product of 40 moles of ethylene oxide with 1 mole of castor oil, 0.1 part by weight of an addition product of 6 moles of ethylene oxide with 1 mole of oleic acid and 0.15 part by weight of the sodium salt of the sulfuric acid half-ester of an addition product of 2 moles of ethylene oxide with 1 mole of coconut fatty alcohol.

The initially dyed material has become markedly lighter whilst the initially undyed material is markedly deeper in shade than in the case of the comparative examples.

If the experiment is carried out analogously with polyester knitted goods which have been dyed with the dyes mentioned in the other comparative experiments, the initially undyed material in every case shows a substantially deeper shade than in the comparative examples.

EXAMPLE 2

10 parts by weight of woven goods made from polyester fibers, dyed with 0.2 part by weight of monobrominated 1,5-dihydroxy-4,8-diamino-anthraquinone, and 10 parts by weight of undyed woven goods made from the same material are together treated for 1 hour at 125° C in 500 parts by volume of an aqueous liquor which contains 0.7 part by weight of n-nonanol, 0.2 part by weight of an addition product of 35 moles of ethylene oxide with 1 mole of caster oil and 0.1 part by weight of the sodium salt of the sulfuric acid half-ester of an addition product of 4 moles of ethylene oxide with 1 mole of nonylphenol. The initially dyed material has become markedly lighter whilst the initially undyed material is substantially deeper in shade than in the case of the comparative examples.

Analogously, the undyed material is found to acquire a substantially deeper shade if the leveling experiments are carried out by boiling material dyed with the dyes mentioned in the other comparative examples, together with undyed material. The effects are substantially more pronounced than in the comparative examples.

EXAMPLE 3

The procedure followed is as in Example 1, but instead of the alcohol mentioned there, a mixture of about equal parts of n-nonanol, 2-methyloctanol, n-undecanol and 2-methyldecanol is used. The initially undyed material acquires a substantially deeper shade than in the case of the comparative examples.

EXAMPLE 4

The procedure followed is as in Example 1, but instead of the alcohol mentioned there, iso-decanol is used. The initially undyed material acquires a deeper shade than in the comparative examples, though it is somewhat less deep than in Examples 2 and 3.

EXAMPLE 5

The procedure followed is as in Example 1, but instead of the alcohol mentioned there, lauryl alcohol is used. The initially undyed material acquires a deeper shade than in the comparative examples, though it is less deep than in Examples 1 to 3.

EXAMPLE 6

200 parts by weight of a polyester yarn are dyed in a cheesedyeing machine with 1 part by weight of monobrominated 1,5-dihydroxy-4,8-diamino-anthraquinone and 0.5 part by weight of 1-amino-2(4'-chlorophenoxy)-4-hydroxy-anthraquinone for 1 hour at 125° C in 2,000 parts by volume of an aqueous liquor which contains 3 parts by weight of 2-ethylhexanol, 0.3 part by weight of an addition product of 35 moles of ethylene oxide with 1 mole of castor oil, 0.3 part by weight of an addition product of 6 moles of ethylene oxide with 1 mole of tallow fatty acid and 0.3 part by weight of the triethanolamine salt of the sulfuric acid half-ester of an addition product of 2 moles of ethylene oxide with 1 mole of nonylphenol. An absolutely level dyeing results.

We claim:

1. In a process for dyeing polyester fibers in water with a disperse dye at a temperature above 100° C, the improvement in obtaining a level dyeing which comprises:

carrying out the dyeing of said fibers from an aqueous liquor containing, in addition to the disperse dye, from 0.05 to 0.5 percent by weight of an aliphatic alcohol of 8 to 12 carbon atoms in the form of an emulsion as the essential leveling agent.

2. A process as claimed in claim 1, wherein the aqueous liquor contains 2-ethylhexanol, n-nonanol, 2-methyloctanol, n-undecanol, 2-methyldecanol, isodecanol or lauryl alcohol as the leveling agent.

3. A process as claimed in claim 1, wherein an aliphatic alcohol having an unbranched carbon chain or at most one methyl or ethyl side chain is used as the leveling agent.

4. A process as claimed in claim 1, wherein a mixture of non-ionic and anionic surfactants is used as an emulsifier.

5. A process as claimed in claim 4, wherein the non-ionic surfactant is a member selected from the group consisting of an unsaturated fatty acid oxyethylated with from 5 to 15 moles of ethylene oxide and castor oil oxyethylated with from 30 to 50 moles of ethylene oxide.

6. A process as claimed in claim 5, wherein the anionic surfactant is selected from the group consisting of the sodium, potassium or ammonium salts of sulfuric acid half-esters of fatty alcohols, of from 9 to 18 carbon atoms, which are oxyethylated with from 2 to 4 moles of ethylene oxide and the same salts of alkylbenzenesulfonic acids or alkylphenols, in each case of 6 to 12 carbon atoms in the alkyl radical.

7. A process as claimed in claim 6 wherein the non-ionic surfactant is employed in an amount of 5 to 40 percent by weight and the anionic surfactant is employed in an amount of 2.5 to 30 percent by weight, the percentages being with reference to said aliphatic alcohol.

8. A process as claimed in claim 1 wherein the content of said aliphatic alcohol in the aqueous liquor is from 0.1 to 0.3 percent by weight.

9. A process as claimed in claim 1 wherein the dyeing temperature is from 120°to 135° C.

* * * * *